US009234269B2

(12) United States Patent
Chavanne et al.

(10) Patent No.: US 9,234,269 B2
(45) Date of Patent: Jan. 12, 2016

(54) METHOD OF TREATING PARTS FOR KITCHEN UTENSILS

(75) Inventors: Herve Chavanne, Noalhat (FR); Philippe Maurin-Perrier, Saint-Marcellin-en-Forez (FR)

(73) Assignee: H.E.F., Andrezieux Boutheon (FR)

( * ) Notice: Subject to any disclaimer, the term of this patent is extended or adjusted under 35 U.S.C. 154(b) by 414 days.

(21) Appl. No.: 13/148,584

(22) PCT Filed: Feb. 18, 2010

(86) PCT No.: PCT/FR2010/050274

§ 371 (c)(1), (2), (4) Date: Aug. 9, 2011

(87) PCT Pub. No.: WO2010/094891

PCT Pub. Date: Aug. 26, 2010

(65) Prior Publication Data

US 2011/0315275 A1 Dec. 29, 2011

(30) Foreign Application Priority Data

Feb. 18, 2009 (FR) ..... 09 51064

(51) Int. Cl.

| | |
|---|---|
| ***C23C 8/32*** | (2006.01) |
| ***C23C 8/26*** | (2006.01) |
| ***C21D 1/06*** | (2006.01) |
| ***C21D 1/74*** | (2006.01) |
| ***C21D 8/02*** | (2006.01) |
| ***C21D 8/04*** | (2006.01) |
| ***C21D 9/18*** | (2006.01) |
| ***C23C 8/36*** | (2006.01) |
| ***C23C 8/56*** | (2006.01) |
| ***C23C 8/76*** | (2006.01) |
| ***C23C 8/80*** | (2006.01) |

(52) U.S. Cl.

CPC ... *C23C 8/26* (2013.01); *C21D 1/06* (2013.01); *C21D 1/74* (2013.01); *C21D 8/0257* (2013.01); *C21D 8/0457* (2013.01); *C21D 9/18* (2013.01); *C23C 8/32* (2013.01); *C23C 8/36* (2013.01); *C23C 8/56* (2013.01); *C23C 8/76* (2013.01); *C23C 8/80* (2013.01)

(58) Field of Classification Search

USPC ..... 148/218, 206

See application file for complete search history.

(56) References Cited

U.S. PATENT DOCUMENTS

| | | | | |
|---|---|---|---|---|
| 3,358,619 | A * | 12/1967 | Pareira | 425/276 |
| 5,571,341 | A | 11/1996 | Jackel | |
| 8,349,094 | B2 | 1/2013 | Boerner et al. | |
| 2007/0267105 | A1 * | 11/2007 | Chou | 148/209 |
| 2008/0118763 | A1 | 5/2008 | Balow et al. | |

FOREIGN PATENT DOCUMENTS

| | | | |
|---|---|---|---|
| RU | 2186149 | C1 | 7/2002 |
| RU | 2194794 | C2 | 12/2002 |
| RU | 2241782 | C1 | 12/2004 |
| RU | 2276201 | C1 | 5/2006 |
| WO | 2008092640 | A1 | 8/2008 |

OTHER PUBLICATIONS

Pinedo, C. E., and W. A. Monteiro. "Surface hardening by plasma nitriding on high chromium alloy steel." Journal of materials science letters 20.2 (2001): 147-150.*

Fukaura, Kenzo, et al. "Fatigue of cold-work tool steels: effect of heat treatment and carbide morphology on fatigue crack formation, life, and fracture surface observations." Metallurgical and Materials Transactions A 35.4 (2004): 1289-1300.*

ASM International, Materials Park, Ohio, Properties and Selection: Irons, Steels, and High Performance Alloys, "Wrought Stainless Steels", Mar. 1990, vol. 1, pp. 841-846.*

Graebener HG et al: "Einfluss Der Stahlzusammensetzung Und Behandlungsparameter Auf Die Eigenschaften Von Nitrocarburierten Bauteilen" HTM Haerterei Technische Mitteilungen: Zeitschrift Fuer Werkstoffe, Waermebehandlung Und Fertigung, Carl Hanser Verlag, Munchen, DE, vol. 44, No. 6, Nov. 1, 1989, pp. 331-338, XP000163078.

Y. Lakhtin et al: "Carbonitriding At 700° C. With Subsequent Hardening of the Surface Layer" Metal Science and Heat Treatment, vol. 29, No. 5, 1987, pp. 359-364, XP002547949.

Pakrasi S: "Niox—Ein Modifiziertes Nitrocarburierverfahren Mit Anschliessender Oxidation", HTM Haerterei Technische Mitteilungen: Zeitschrift Fuer Werkstoffe, Waermebehandlung Und Fertigung, Carl Hanser Verlag, Munchen, DE, vol. 43, No. 6, Nov. 1, 1988, pp. 365-374, XP000003207.

International Search Report, dated May 6, 2010, in PCT/FR2010/050274.

Lyakhovich, L.S., "Thermochernical Treatment of Metals and Alloys", Moscow, Metallurgy, 1981, p. 46, paragraphs 6, 4.

Lakhtin Yu.M., "Material Science", Moscow, 'Mashinostroenie' Publisher, 1980, p. 176, paragraph 4.

English translation of Russian Office Action, dated Nov. 22, 2013, from corresponding RU application.

* cited by examiner

*Primary Examiner* — Jessee Roe

(74) *Attorney, Agent, or Firm* — Young & Thompson

(57) ABSTRACT

A method for processing parts for kitchen tools in order to protect the parts from scratches, includes sequentially: a nitridation step, optionally including a nitrocarburizing step, between 592 and 750° C. in order to promote the formation of a nitrogen austenite layer; and a processing step for promoting the conversion of at least a portion of the nitrogen austenite into a phase with reinforced hardness.

21 Claims, 2 Drawing Sheets

METHOD OF TREATING PARTS FOR KITCHEN UTENSILS

FIELD OF THE INVENTION

The invention concerns a method of treating parts for kitchen utensils of ferrous alloys that are non-stick, scratch resistant and corrosion resistant and parts treated by the method.

BACKGROUND OF THE INVENTION

It is known to use different materials, or stacking of materials, to produce kitchen utensils: steel (alloyed or not), aluminum, stainless steel (that is to say, generally containing more than 11% chromium), copper or silver alloys in particular, with or without surface coatings such as polymer layers based on polytetrafluoroethylene (PTFE, distributed in particular under the trademark Teflon). Each material has its own advantages and drawbacks for this type of application.

Aluminum is very resistant to corrosion during steps of washing the utensils, including in a dishwasher with detergents, but on the other hand can easily be scratched and its non-stick properties are mediocre. For this reason it is often associated with a coating of polytetrafluoroethylene type.

Austenitic stainless steel (containing approximately 18% chromium and 10% nickel) also has good corrosion resistance and slightly better scratch resistance than aluminum. On the other hand, it is a poor heat conductor which does not facilitate the homogenization of temperature for cooking utensils such as woks, frying pans, griddles, casserole dishes, pots, broiler plates, fryers, grills (barbecues), molds or saucepans.

Copper is a very good heat conductor which is recognized for providing good quality cooking. However, it is an expensive material reserved for top of the range utensils.

Non-stainless steels have a great advantage over all the other aforementioned materials, which is their price. To be precise, steels, especially unalloyed steels (those without any added component) or weakly alloyed steels (that is to say in which no added component exceeds 5% by weight), are easily and abundantly available, their price is low and varies little relative to that of stainless steels or copper. It is for this reason that non-stainless steels are very widely used as the basic material for bottom of the range utensils.

However, these steels have very low corrosion resistance, especially on cleaning the utensils with detergents (washing in a dishwasher is ruled out), their surface is easily scratched and their non-stick properties are mediocre.

The teaching of patent US 2008/0118763 A1 shows that ferritic nitrocarburizing may be applied to kitchen utensils at a temperature of 1060° F. (571° C.) for 3 h in an atmosphere of 55% nitrogen, 41% ammonia and 4% $CO_2$. Carried out next are gaseous oxidation (post-oxidation) at a temperature of 800° F. (~427° C.) and temporary protection by baking at 500° F. (260° C.) for 45 minutes using a cooking oil. According to this document, the treated surfaces have increased hardness and improved corrosion resistance.

The treatments of nitriding, nitrocarburizing, oxinitriding and oxinitrocarburizing (the prefix oxi- means that after the nitriding or nitrocarburizing, an oxidizing step is carried out) are used in the mechanical industry (in the automotive sector: valves, gas struts, ball joints; in construction equipment: articulations, hydraulic jacks, etc.)

These treatments are carried out industrially either using gas (ammonia-based atmospheres) or using plasma (glow discharge at low pressure), or using liquid (ionic liquid media, see for example the document US2003084963).

In industry, the treatments of nitriding, nitrocarburizing, oxinitriding and oxinitrocarburizing are conventionally carried out in the ferritic phase (in the iron-nitrogen diagram), that is to say at temperatures less than 592° C.

A layer of iron nitride is formed, and the layer below is referred to as diffusion layer.

Beyond 592° C., the γN phase forms (nitrogen-containing austenite, generally named γN) between the nitride layer and the diffusion layer. Nitrogen-containing austenite is a microstructure that is particular to steel. The precise temperature beyond which the γN phase forms depends on the exact composition of the steel. If the latter contains a lot of alloying components, this temperature limit value may shift up to 600° C.

This nitrogen-containing austenite layer transforms into nitrogen-containing braunite, another microstructure particular to steel, under the effect of temperature at the oxidation step which is conventionally carried out after the nitriding or nitrocarburizing step. However, in the field of mechanical parts, the oxidation step is generally carried out since it is desired that the parts be corrosion resistant, nitriding increasing wear resistance and the oxidation increasing the corrosion resistance.

This retransformation into braunite is not generally desired since for the mechanical applications for which nitrocarburizing is generally destined, the presence of a nitrogen-containing braunite layer gives rise to fragility in case of impact.

More particularly, the typical mechanical stresses whose effect it is usually sought to limit by nitrocarburizing are cyclic stresses and/or alternating stresses which will recur with a high number of cycles, such as for example superficial fatigue or impact.

The presence of a braunite layer is thus generally ruled out since the fragility of that layer may lead to flaking or splitting of the nitride layer under the effect of impact (high energy transfer which is brief and localized between two parts moving relative to each other). Nitrocarburizing and nitriding are thus conventionally carried out in ferritic phase. When austenitic nitriding is carried out, the post-oxidation step is then generally performed at a temperature below 200° C. to avoid the retransformation of the nitrogen-containing austenite into braunite (see for example patent EP1180552).

Furthermore, with regard to the teaching of patent US 2008/0118763 A1, the applicant has noted that at the post-oxidation step carried out just after the nitrocarburizing, the high temperatures used (greater than 200° C.) give rise to tempering in the diffusion zone. The consequence of this annealing is a drop in the hardness of the diffusion zone which is detrimental to the scratch resistance of the kitchen utensils treated.

Consequently, when a load is applied which stresses the material in its core and not just the hard surface layer, the substrate deforms and the hard surface layer splits and flakes.

The same applies to the step of baking the temporary protective agent which is carried out between 150 and 260° C., as well as during the life of the utensils, at each utilization above 200° C. of those kitchen utensils.

This is in particular detrimental in the case of the low carbon steels which are generally used for kitchen utensils.

It is moreover to be noted that nitrocarburizing methods require a high energy input, and that it is desirable to control the treatment time, to limit the final costs. One of the drawbacks of the treatment range presented by document US 2008/0118763 A1 is its duration which is long (3 hours).

In this context, the problem which the invention sets out to solve is to give improved non-stick, scratch resistant and corrosion resistant properties to the surface of kitchen utensils made of steel (not alloyed or weakly alloyed), with improved production costs.

SUMMARY OF THE INVENTION

To solve this problem a method is provided of treating parts for kitchen utensils characterized in that it comprises successively:

- a nitriding step between 592 and 750° C. so as to promote the creation of a nitrogen-containing austenite layer
- a treating step adapted to promote the conversion of at least part of the nitrogen-containing austenite into a phase of enhanced hardness.

The method is remarkable in that it is implemented to protect the parts for kitchen utensils against scratches.

The initial hardening of the parts (nitriding step) may be carried out either by austenitic nitriding, or by austenitic nitrocarburizing. It should be clearly understood that what is meant by nitrocarburizing is a treatment by diffusion of nitrogen and carbon, considered as a particular case of nitriding, by which term a treatment is designated in the general sense involving at least a diffusion of nitrogen. The austenite layer created is buried under the nitride layer, above the diffusion layer.

The subsequent treating step, which may in particular be a heat treatment or a thermo-chemical treatment, results in enhancing the hardness of the nitrogen-containing austenite, the nature of which changes. The hardness is measured using the standard protocols. By way of example, it is preferably enhanced by at least 200 $HV_{0.05}$ or possibly 300 $HV_{0.05}$.

According to a first embodiment, the phase with enhanced hardness is braunite. The conversion may in this case in particular be carried out by passing to over 200° C. for a time longer than 10 minutes. In an example relative to this embodiment, the hardness of the phase that changes nature thus passes from approximately 400 $HV_{0.05}$ to approximately 800 $HV_{0.05}$.

The treating step is adapted to enable the conversion of the nitrogen-containing austenite layer into nitrogen-containing braunite. For this, in particular, it is carried out with a low content of activated nitrogen around the parts. By activated nitrogen is meant, depending on the nitriding route used, gaseous ammonia, ionized nitrogen or molten nitrogenous salts.

A simple way to implement the conversion is to eliminate any presence of activated nitrogen in the medium in which the parts are placed, but it is possible merely to reduce the concentration of those activated species sufficiently to stop the nitriding reaction. The conversion is implemented at a temperature less than or equal to the nitriding temperature, for example at a temperature less than 480° C.

It is to be noted that between the nitriding step and the conversion step, the parts may be moved, or be kept in the same place.

Furthermore, the conversion step may be carried out just after the nitriding step, without the parts having been cooled, which enables favorable kinetics to be obtained, but it may also be carried out after a lapse of time during which the parts have been subjected to ambient temperature.

According to a second embodiment, the phase with enhanced hardness is nitrogen-containing martensite, and the conversion may in particular be carried out by a passage to below −40° C. for a time longer than 5 minutes. Nitrogen-containing martensite is a particular microstructure of steel, different from nitrogen-containing austenite and from braunite. In an example relative to this embodiment, the hardness of the phase that changes nature thus passes from approximately 400 $HV_{0.05}$ to approximately 750 $HV_{0.05}$.

For the application for cooking utensils, the applicant has found that the stacking of layers of materials so obtained with the method has better resistance to scratches made by pointed utensils (forks, knives) than a stacking obtained by ferritic nitriding. It would seem that the braunite or martensite layer formed during the conversion step serves as a support for the nitride layer situated below.

More particularly it would appear that at the time of surface mechanical stresses typical of a kitchen utensil use (stirring, cutting of food), the area of contact between the cooking utensils and the pointed utensils is very small).

With nitriding or ferritic nitrocarburizing, the applicant has found, as mentioned above, that the nitride layer collapses locally since the diffusion layer is not sufficiently hard (200-250 $HV_{0.05}$ for low carbon non-alloy steels) to support it. Localized deformation of the part occurs, as well as of the nitride layer which splits and flakes.

Without wishing to be bound by a particular explanation, it would seem that with austenitic nitrocarburization, the nitrogen-containing austenite retransformed into braunite or into martensite provides mechanical support for the nitride layer having much better performance than that given by the diffusion layer alone in the parts not having been treated according to the invention. The nitride layer no longer deforms under the typical mechanical stresses of cooking utensils, which eliminates the scratching phenomena.

The same applies for corrosion resistance. By nature, the nitride and oxide layers are passive layers, that is to say they do not rust. Corrosion of oxinitrided or oxinitrocarburized parts may however occur since the nitride and oxide layers are never free from defects. The electrolyte may then enter into contact with the substrate which consequently corrodes.

Limiting the risk of scratches to the nitride and oxide layers by virtue of the treatment according to the invention protects against the corrosion of the cooking utensils treated according to the invention.

It is noted that the effect observed is linked to the application for the kitchen utensils, for which the frequency of stressing of the surface is low (a few jabs with a knife or spatula from time to time) and not generally at the same location (it is rare for several tens or hundreds of jabs by a knife to be given exactly at the same location in a frying pan). The method thus applies advantageously to utensils such as woks, frying pans, griddles, casserole dishes, pots, broiler plates, fryers, grills (barbecues), molds or saucepans, and in particular to their surfaces destined to enter into contact with food during cooking. The utensils are adapted to be used for domestic, group, restaurant or industrial cooking for the preparation of cooked food destined for example to be packaged and distributed.

It thus seems that the advantageous character of the presence of the braunite or martensite layer is due to the fact that it makes it possible to avoid excessively steep hardness gradients (as is the case between the nitride layer and the diffusion layer with conventional nitriding of steels of XC10-XC20 type).

The braunite or martensite layer, which is of hardness intermediate between that of the nitride layer and that of the diffusion layer apparently reduces this gradient in such a manner that better mechanical durability is obtained. This is all the more advantageous in that, as was mentioned above, the oxidation step leads to a drop in hardness in the diffusion zone.

Furthermore, using treatment temperatures comprised between 595 and 700° C. it is possible to multiply by two or three the diffusion kinetics relative to a treatment carried out between 530 and 590° C., which enables the treatment cost to be reduced and to reduce the energy needs required to perform it.

In certain advantageous modes of implementation, the treating step adapted to promote the conversion into braunite is also a controlled oxidation step, which in addition enables an enhanced protective effect against corrosion to be obtained.

Alternately, or in combination, the conversion into braunite comprises baking at more than 250° C. for a time comprised between 20 minutes and 3 hours and this baking is further to or precedes an oxidation in boiling brine between 120 and 160° C. The brine may in particular be at a temperature between 130 and 145° C.

According to one procedure for implementation, the method, which involves a conversion into braunite or martensite, further comprises oxidation using gas between 350 and 550° C.

Alternatively or in combination, it comprises an oxidation by baths of molten salt between 350 and 500° C.

Alternatively, or in combination, it comprises an oxidation by boiling brine between 120 and 160° C., or between 130 and 145° C.

Preferably, the nitriding comprises a nitrocarburizing phase. It may also comprise a phase of nitriding alone followed by or preceded by a nitrocarburizing phase. Thus, it is possible for the nitrocarburizing phase to be complemented by a phase of nitrogen diffusion without carbon diffusion.

The nitrocarburizing is advantageous since it makes it possible to obtain single phase nitride layers to be obtained which improves the mechanical durability of the parts, in particular to impacts or scratches, for example, beyond what is obtained when the invention is implemented with nitriding without nitrocarburizing.

According to one embodiment, the nitriding comprises nitriding in gaseous phase which may comprise nitrocarburizing in gaseous phase. According to another embodiment, it comprises nitriding with plasma which may comprise nitrocarburizing with plasma.

According to a third embodiment, it comprises nitriding in an ionic liquid medium which may comprise nitrocarburizing in an ionic liquid medium.

According to an advantageous feature, the nitriding is carried out for a time comprised between 10 minutes and 3 hours, and preferably between 10 minutes and 1 hour.

It may preferably be carried out at a temperature comprised between 610 and 650° C.

The method is advantageously complemented by prior degreasing of the parts.

Furthermore the method advantageously comprises a step of prior heating of the parts to treat between 200 and 450° C. in an oven for a time comprised between 15 and 45 minutes, after the degreasing and before the nitriding, so as to prepare the parts for the nitriding. This enables time to be saved in the implementation of the method, in particular because the parts do not cool the reaction medium when they are introduced therein.

According to another advantageous feature, the parts receive temporary oily protection at the end of the treatment, to increase their corrosion resistance, beyond the protective effect already obtained with the treatment according to the invention without that additional protection.

Finally, the method is advantageous in that in addition it gives the treated parts wear resistance properties and non-stick properties.

It is to be noted that the method is in particular applied to parts of ferrous alloy comprising at least 80% of iron by weight, or even to non-alloy or weakly alloyed parts.

BRIEF DESCRIPTION OF THE DRAWINGS

The invention also provides kitchen utensils treated by the method according to the invention.

The invention will now be described in detail, with reference to the accompanying drawings, in particular.

DETAILED DESCRIPTION OF THE INVENTION

Figure 1:
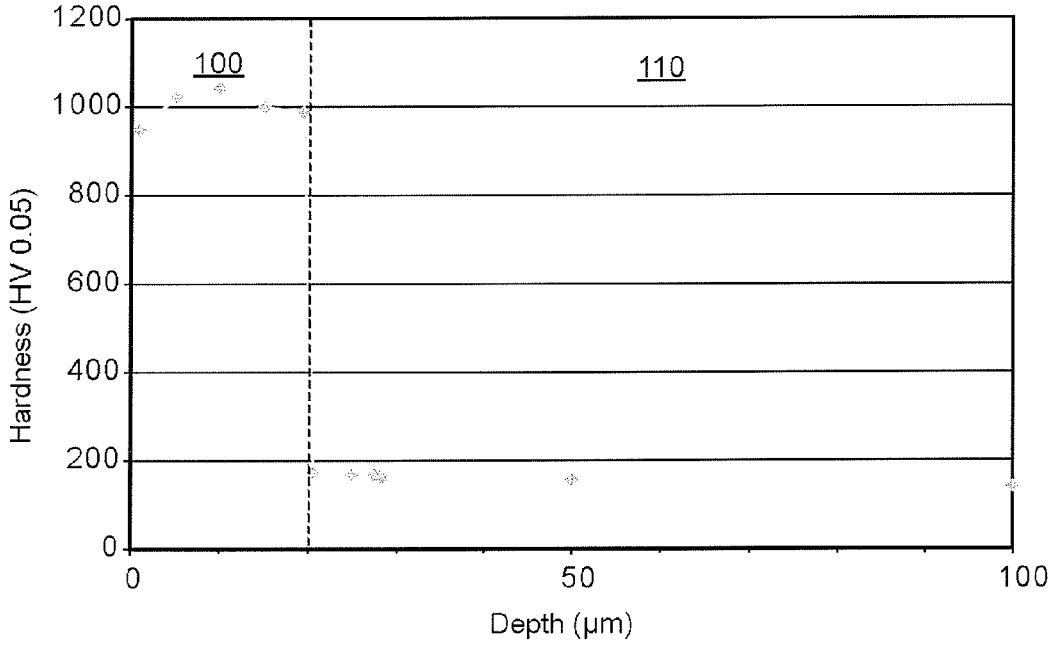
FIG. 1 which shows a hardness profile measured on a similar cooking utensil treated by a method of the prior art, FIG. 2 which shows a hardness profile measured on a cooking utensil treated according to a preferred embodiment of the invention, FIG. 3 which presents a superposition of the two preceding profiles.

The treatment range may be broken down into several steps: First of all, degreasing of the parts is carried out to eliminate any trace of organic compounds on the surface which could hinder the diffusion of nitrogen and/or carbon.

Next, the parts are brought to austenitic nitrocarburizing or nitriding temperature (between 592 and 750° C.), but preferably to temperatures comprised between 610 and 650° C. The nitriding or nitrocarburizing treatment is of a duration comprised between 10 minutes and 3 hours, preferably from 10 minutes to 1 hour.

In a third phase, the parts are oxidized at a temperature comprised between 350 and 550° C., preferably from 410 to 440° C.;

Alternatively, oxidation at a temperature between 120 and 160° C. in boiling brine may be carried out, preferably between 130 and 145° C.

In this case, baking of the parts at a temperature greater than 250° for a time comprised between 20 minutes and 3 hours, preferably 1 hour, is necessary to convert the γN layer into braunite.

The parts lastly receive temporary protection in the form of a food-grade oil to increase their corrosion resistance, beyond the effect of protection already obtained with the treatment according to the invention without that additional protection.

Tests have shown the great advantages obtained by the range of treatment as provided by the invention. Austenitic nitrocarburizing was carried out at 640° C. for 45 minutes in an ionic liquid medium containing 15% cyanates, 1% cyanides and 40% carbonates by weight.

The parts were then directly tempered in an oxidation bath at 430° C. for 15 minutes. Next, the parts were cooled in water, rinsed and dried. At the end, the food-grade oil (sunflower oil) was applied to the surface to increase the corrosion resistance.

The morphology of the oxide layer serves as a sponge for the film of oil that remains trapped in the microporosity of the layer. Although it is not necessary to carry out a final baking step, this may be carried out in order to promote the retention of the oil by the oxide layer.

The treatment results in greatly increasing the hardness of the layer supporting the nitride layer, relative to a treatment according to the prior art.

FIG. 1 shows the hardness profile (measured using the Vickers standard protocol), for a part (steel XC10) treated according to the prior art (ferritic nitrocarburizing and oxidation). The hardness is measured on a cross-section. The hardness of the nitride layer 100 is of the order of 1000 $HV_{0.05}$, whereas the hardness of the diffusion layer 110 is of the order of 180 $HV_{0.05}$. The transition between the hardnesses of the two layers is abrupt, over less than 3 microns, at a depth of in the neighborhood of 20 microns.

Figure 2:
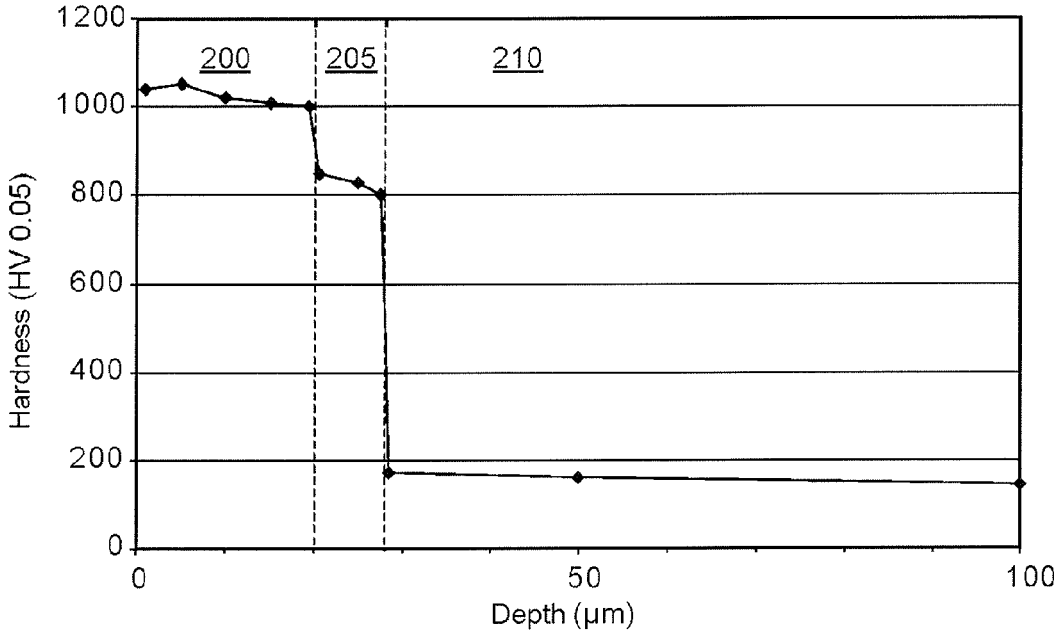

FIG. 2 shows the hardness profile for an identical part, treated according to the described embodiment of the invention. The hardness is also measured on a cross-section. The hardness of the nitride layer is of the order of 1000 $HV_{0.05}$, and that of the diffusion layer of the order of 180 $HV_{0.05}$. Two transitions are visible in the hardness profile: one at 20 microns, and the other at 28 microns. The hardness of the intermediate layer, referred to as nitrogen-containing braunite layer is of the order of 820 $HV_{0.05}$. The overall gradient is smaller than in FIG. 1.

Figure 3:
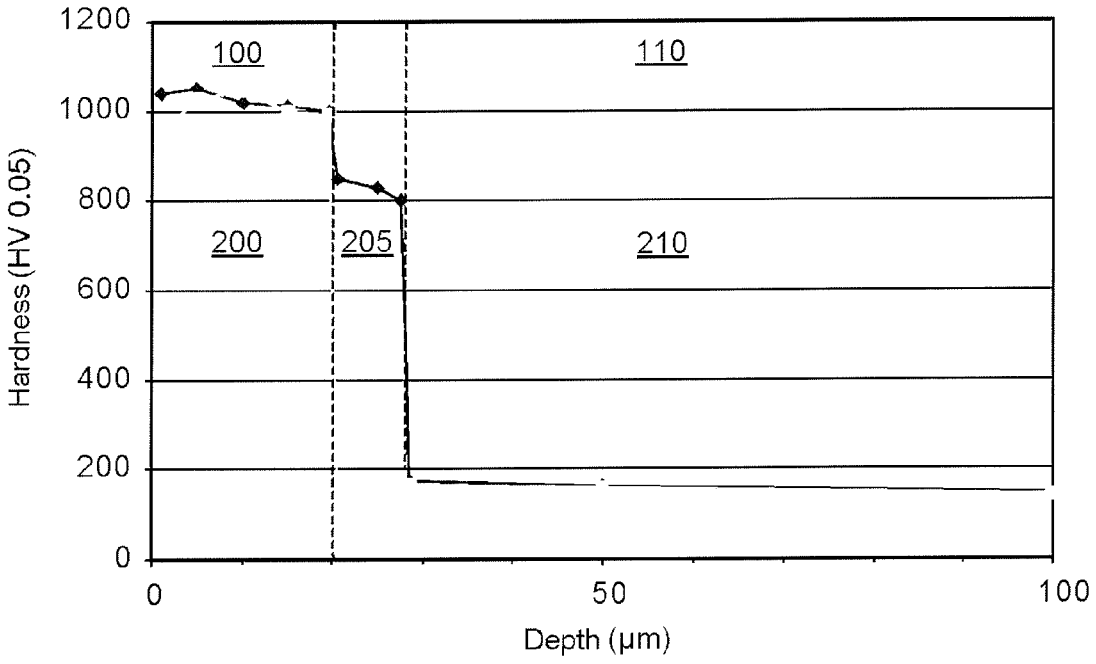

FIG. 3 shows the comparison between the hardness profiles observed after the treatment according to the invention, and after the treatment of ferritic nitrocarburizing and oxidation.

The hardness of the intermediate layer 205 is comprised between that of the diffusion layer 210 and that of the nitride layer 200.

Furthermore, the range thus produced takes only one hour of temperature, which clearly shows the efficiency of the invention in energy terms.

The utensils obtained have enhanced non-stick properties, shown by the ease of cleaning of burnt food after use.

Alternatives to the treatment presented will now be detailed. The nitrocarburizing treatment may be carried out in gaseous phase with atmospheres based on ammonia ($NH_3$), nitrogen ($N_2$) and one or more carbon-containing gases such as methane, ethane, propane, butane, pentane, acetylene, carbon monoxide, carbon dioxide, endothermic gas, and exothermic gas.

The nitrocarburizing treatment may also be carried out using plasma: in a vessel under reduced pressure (typically 5-7 mbar) the parts are polarized under high voltage. A glow discharge is then created and the gas mixture (typically 79.5% $N_2$+20% $H_2$+0.5% $CH_4$) is dissociated which enables the activated carbon and nitrogen to diffuse.

The nitrocarburizing treatment may also be carried out using liquid (ionic liquid media), as mentioned, in a bath of molten carbonates, cyanates and cyanides. The cyanate ions ($CNO^-$) serve as a source of nitrogen whereas the traces of cyanides ($CN^-$) serve as a source of carbon.

The oxidation step must be controlled and may be carried out using gas with oxidizing atmospheres such as air, controlled $N_2/O_2$ mixtures, steam, nitrous oxide, etc. In all cases the aim is to form, at temperatures comprised between 350 and 550° C., a layer of black iron oxide $Fe_3O_4$, which is a passive oxide which, once formed, avoids the formation of rust iron oxide $Fe_2O_3$ which is red).

The oxidation may also be carried out in ionic liquid media at temperatures comprised between 380 and 470° C., for times ranging from 5 to 40 minutes.

The oxidation may lastly be carried out in brine (mixture of water, nitrates, hydroxides) at a temperature comprised between 100 and 160° C., for times ranging from 5 to 40 minutes.

In this case, post-heat-treatment at a temperature greater than 250° C. is necessary to retransform the layer of γN into braunite.

According to a second embodiment, the nitrogen-containing austenite is re-transformed into nitrogen-containing martensite by cryogenic treatment between −40 and −200° C. for a time comprised between 5 minutes and 3 hours, preferably between 1 hour and 2 hours.

The nitrogen-containing martensite is a structure whose hardness is in the neighborhood of that of the nitrogen-containing braunite. The applicant has found that the effect of mechanical support for the iron nitride layer is provided.

According to this embodiment, the treatment range is then the following:

- de-greasing to remove any trace of organic product
- preheating to a temperature comprised between 250 and 400° C.,
- austenitic nitrocarburizing between 592 and 650° C.
- cooling to ambient temperature
- cryogenic treatment at a temperature between −40 and −200° C.,
- oxidation either using gas, or by salt baths, or in boiling brine.

In this embodiment, the applicant has found that the oxidation by a boiling brine is advantageous since it enables hardness of the nitrogen-containing martensite to be obtained that is greater by 100 Vickers than that obtained with oxidation at high temperature (more than 300° C. using gas in particular).

The invention is not limited to the described embodiments, but encompasses all the embodiments within the capability of the person skilled in the art.

The invention claimed is:

1. A method of treating kitchen utensil parts to protect against scratches, the parts comprising a ferrous alloy of at least 80% iron by weight, the method comprising:

austenitic nitriding or nitrocarburizing said parts, to create an outer nitride layer, an inner diffusion layer, and an intermediate nitrogen austenite layer between the nitride layer and the diffusion layer;

treating said nitrided or nitrocarburized parts by oxidation to convert at least part of the nitrogen-austenite into nitrogen-braunite or nitrogen-martensite and creating an area of enhanced hardness having a hardness intermediate between that of the nitride layer and the diffusion layer.

2. The method according to claim 1, wherein at least a part of the nitrogen-austenite is converted into nitrogen-braunite.

3. The method according to claim 2, wherein said treating by oxidation is carried out at a temperature greater than 200° C. for a time longer than 10 minutes.

4. The method according to claim 1, wherein at least a part of the nitrogen-austenite is converted into nitrogen-martensite.

5. The method according to claim 4, wherein said treating by oxidation is carried out at a temperature less than −40° C. for a time longer than 5 minutes.

6. The method according to claim 1, wherein said treating by oxidation comprises oxidizing said parts by molten salt bath, at a temperature between 350° C. and 500° C.

7. The method according to claim 1, wherein said treating by oxidation comprises oxidizing said parts using gas, at a temperature between 350° C. and 550° C.

8. The method according to claim 1, wherein said treating by oxidation comprises oxidizing said parts in boiling brine, at a temperature between 120° C. and 160° C.

9. The method according to claim 1, wherein the austenitic nitriding or nitrocarburizing comprises nitrocarburizing, optionally followed by a phase of nitriding.

10. The method according to claim 1, comprising austenitic nitriding or nitrocarburizing in an ionic liquid medium.

11. The method according to claim 1, comprising austenitic nitriding or nitrocarburizing with plasma.

12. The method according to claim 1, comprising austenitic nitriding or nitrocarburizing in gaseous phase.

13. The method according to claim 1, wherein the austenitic nitriding or nitrocarburizing is carried out for a time between 10 minutes and 3 hours.

14. The method according to claim 1, wherein the austenitic nitriding or nitrocarburizing is carried out at a temperature between 610° C. and 650° C. for a time between 10 minutes and 1 hour.

15. The method according to claim 1, further comprising degreasing the parts prior to the nitriding or nitrocarburizing.

16. The method according to claim 1, further comprising heating the parts between 200° C. and 450° C. for a time between 15 minutes and 45 minutes prior to the nitriding or nitrocarburizing.

17. The method according to claim 1, wherein the parts receive temporary oily protection at the end of the treatment.

18. The method according to claim 1, wherein the parts comprise non-stainless steel.

19. The method according to claim 1, wherein the austenitic nitriding or nitrocarburizing is carried out at a temperature between 592° C. and 750° C. for a time between 10 minutes and 3 hours.

20. The method according to claim 1, wherein the nitrogen-braunite or nitrogen-martensite area of enhanced hardness has a Vickers hardness of from 400 $HV_{0.05}$ to about 800 $HV_{0.05}$.

21. The method according to claim 1, wherein the nitride layer has a Vickers hardness of about 1000 $HV_{0.05}$, the nitrogen-braunite or nitrogen-martensite area of enhanced hardness has a Vickers hardness of about 400-800 $HV_{0.05}$, and the diffusion layer has a Vickers hardness of about 180-250 $HV_{0.05}$.

* * * * *